US005916006A

United States Patent [19]

Ganson

[11] Patent Number: 5,916,006

[45] Date of Patent: Jun. 29, 1999

[54] FLEXIBLE FOAM CONSTRUCTION TOY SET

[75] Inventor: Arthur M. Ganson, Somerville, Mass.

[73] Assignee: HandsOnToys, Inc., Woburn, Mass.

[21] Appl. No.: 08/857,158

[22] Filed: May 15, 1997

Related U.S. Application Data

[63] Continuation of application No. 08/511,481, Aug. 4, 1995, abandoned, which is a continuation-in-part of application No. 08/265,809, Jun. 27, 1994, Pat. No. 5,498,190.

[51] Int. Cl.[6] ..... A63H 33/08; A63H 33/00; A63H 33/04

[52] U.S. Cl. ..... 446/85; 446/107; 446/486

[58] Field of Search ..... 446/1, 119, 490

[56] References Cited

U.S. PATENT DOCUMENTS

| | | | |
|---|---|---|---|
| 1,329,850 | 2/1920 | Pye | 446/119 X |
| 2,523,965 | 9/1950 | Morrison | 446/1 |
| 2,542,601 | 2/1951 | Van Cleef | 132/246 |
| 4,164,091 | 8/1979 | Lin | 446/118 |
| 4,648,414 | 3/1987 | Fox et al. | 132/246 |
| 4,666,417 | 5/1987 | Hillman | 446/267 |
| 4,823,458 | 4/1989 | Hollenberg et al. | 132/246 X |
| 5,282,767 | 2/1994 | Gelardi | 446/107 X |

FOREIGN PATENT DOCUMENTS

| | | | |
|---|---|---|---|
| 478649 | 11/1951 | Canada | 446/1 |
| 2116032 | 9/1983 | United Kingdom | 132/246 |

*Primary Examiner*—D Neal Muir
*Attorney, Agent, or Firm*—Brian M. Dingman

[57] ABSTRACT

A flexable foam construction toy set, comprising: a plurality of elongated foam tube toys, each having an elongated foam body, with a flexible wire adhered therein, to allow each foam tube toy to be bent and retain its bent shape; wherein each tube toy is capable of connection to another tube toy by intertwining the tube toys to be interconnected without the need for defined interconnection structures.

31 Claims, 9 Drawing Sheets

FLEXIBLE FOAM CONSTRUCTION TOY SET

RELATED APPLICATION

This application is a continuation of application Ser. No. 08/511,481, filed on Aug. 4, 1995, now abandoned, which is a continuation in part of application Ser. No. 08/265,809, filed Jun. 27, 1994 now U.S. Pat. No. 5,498,190.

FIELD OF INVENTION

This invention relates to a flexible foam construction toy set featuring tubes that can be bent in a variety of shapes, and that are interconnectable without the need for defined interconnection structures.

BACKGROUND OF INVENTION

One type of child's construction toy is a type which consists of a number of interconnectable pieces. Often these pieces are rigid. Sometimes the pieces have the interconnection structures built therein, and other times there are separate pieces that serve to interconnect other pieces. Although these rigid toy pieces have great variety, the child is limited by the particular size and shape of the pieces of the construction toy set, and the connection structures.

Some such interconnectable construction toy sets use flexible pieces. One such toy uses plastic-coated wire pieces with special integral end designs which allow the pieces to be interconnected. Even this limits the child's use of the toy, however, as the pieces are not adapted to be interconnected at places other than their ends. Additionally, the relatively thick wire and relatively dense plastic coating are sufficiently massive that they effectively limit the size of the toy pieces.

SUMMARY OF INVENTION

It is therefore an object of this invention to provide a construction toy set which can be used to make virtually any shape of any size.

It is a further object of this invention to provide such a construction toy set in which the toy pieces can be interconnected anywhere along their lengths.

It is a further object of this invention to provide such a construction toy set in which the toy pieces can be directly interconnected, without the need for integral or separate interconnection structures.

It is a further object of this invention to provide such a construction toy set in which the pieces are extremely light so that they can be made very large and/or long.

This invention results from the realization that a superior construction toy set may be accomplished with extruded foam tubes with a central, relatively thin, flexible wire therein. Such tubes can be bent to any shape, and can be interconnected by wrapping around one another.

This invention features a flexible foam construction toy set, which includes a number of elongated foam tube toys that are preferably cylindrical. Each of the toys has an elongated foam body, preferably about 1' to 6' in length, and preferably made from a plastic foam having a density of from 2 to 6 pounds per cubic foot. There is a flexible wire, which is preferably a 0-temper aluminum wire with a diameter of from about 1/32" to 1/2". The wire is adhered within, and preferably centrally embedded within, the foam body. The wire allows the foam tube to be bent and retain its bent shape. This provides a toy set in which each tube toy is capable of connection to another tube toy by intertwining the tube toys, to allow the toys to be interconnected without the need for defined interconnection structures, either integral with or separate from the tubes, as are required in other similar construction toy products.

The adhesive coated wire and foam can be coextruded, in which case the ends of the tubes must be capped or finished to cover the exposed ends of the wire. Alternatively, the wire can be made slightly shorter than the tube and be provided with enlarged ends, and then embedded within the tube. This may be accomplished by including a central aperture in the tube into which the wire is pushed. In that case, the wire is completely embedded within the body, and the ends of the body would be closed off, for example by closing the aperture.

This invention also features flat foam toy pieces having one or more holes which are sized to snugly fit the elongated foam tube toys. These pieces can be cut into any shape, including geometric shapes such as circles, squares, rectangles and triangles, and odd shapes such as stars, polygons, or rounded shapes. These foam pieces are made from a relatively thin plastic foam material and do not have an embedded wire. They act as adjuncts to the elongated posable foam tube toys, and in combination with the foam tube toys add additional shape and dimensionally to designs that can be created with the toy set of this invention. They also provide the ability to animate figures made by interconnecting the foam tube toys of this invention.

BRIEF DESCRIPTION OF THE DRAWINGS

Other objects features and advantages will occur to those skilled in the art from the following description of preferred embodiment, and the accompanying drawings, in which.

DESCRIPTION OF THE PREFERRED EMBODIMENTS

Figure 1:
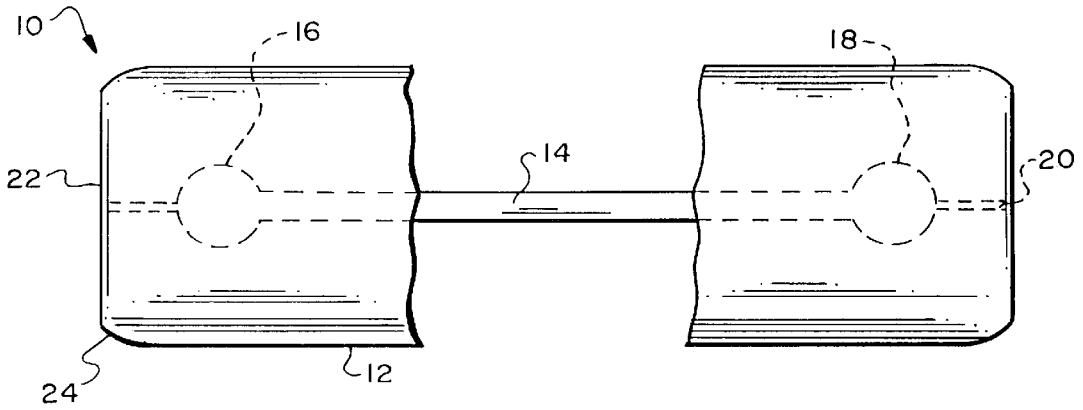
FIG. 1 is a side view of a tubular, flexible foam construction toy of the toy set according to this invention, with a portion of the tube removed to detail the interior structure.
Figure 2:
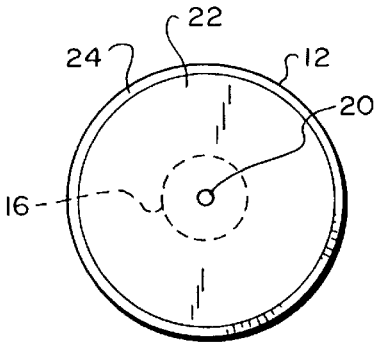
FIG. 2 is an end view of the toy of FIG. 1.
Figure 3:
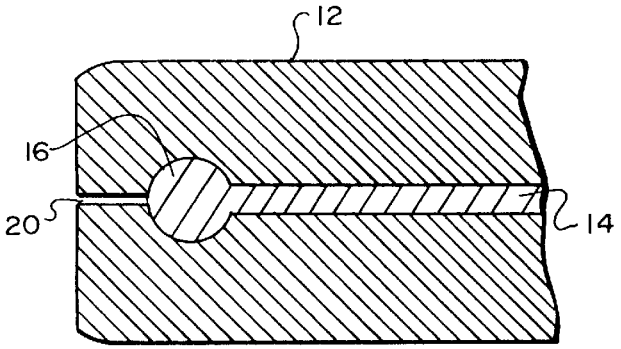
FIG. 3 is a partial cross sectional view of the toy of FIG. 1.
Figure 13:
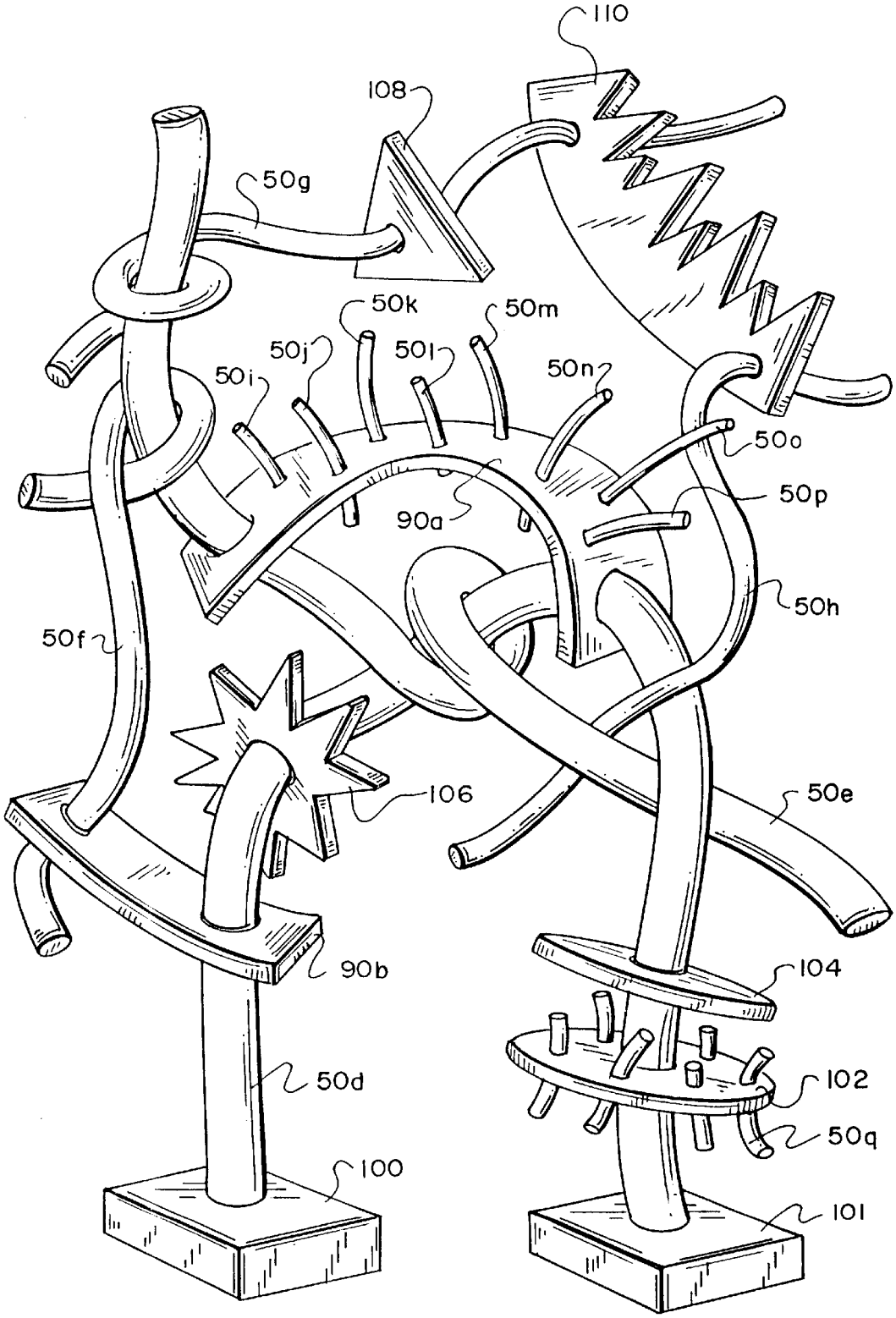
FIG. 13 is a view of many pieces put together to form a fanciful construction.

There is shown in FIGS. 1 through 3 flexible foam construction toy 10 according to this invention. Toy 10 is made from tubular elongated foam body 12 having central aperture 20 which is typically approximately 1/32" to 1/2" in diameter. The foam body can take a variety of shapes as illustrated in FIGS. 7 through 11, for example. Flexible wire 14 having enlarged ends 16 and 18 is embedded within body 12 along aperture 20. The foam tubes can thus be bent to, and will hold, different shapes. This also allows the tubes to be interconnected by wrapping around one another as shown in FIG. 13. Thus, the toy set usage is not dictated by the size, shape or location of connecting structures found in other construction toy sets.

Wire 14 is preferably zero-temper aluminum wire having a thickness between 1/32" and 1/2". The size of the wire adheres to the following principle: The ratio of the foam OD to the diameter of the wire will range from 4:1 to 20:1 for a 2.5 lb per cubic foot (pcf) foam. The upper range of this ratio will change as the foam density changes by a factor of: 2.5/density of foam used. For example a 1.25 lb pcf foam would have the ratio of 4:1 to 2.5/1.25×20:1 or 40:1. A 5 lb pcf foam would have the ratio of 2:1 to 10:1. In the case of non-cylindrical bodies, the measurement used for this ratio should be the diameter of the largest circle that can be drawn completely within the figure. Enlarged ends 16 and 18 in this case are formed by enlarging the wire ends, for example by balling the ends in a coining or molding process.

Toy 10 may be manufactured first by extruding foam body 12 and cutting off the extrusion to the desired length. The foam is preferably polyurethane or polyethylene with or without additives, with a density from 2 to 6 pounds per cubic foot. This material has enough flexibility to allow wire 14, including enlarged ends 16 and 18, to be inserted into aperture 20. Before wire 14 is inserted in the aperture, it or the aperture is coated with an adhesive such as a glue, epoxy, heat activated adhesive or other adhesives to assist in maintaining the wire in place within body 12. If a heat-activated adhesive is used, it can be activated by placing the toy in an oven, or by heating the metal wire by rf induction.

It has been found that the ends of wire 14 should be within a distance equal to the diameter of a cylindrical foam body, or the diameter of the largest circle that can be drawn completely within a non-cylindrical foam body, from the ends of body 12. To further assist in maintaining wire 14 in place and preventing it from puncturing body 12 or slipping out one of the ends of aperture 20, aperture 20 of body 12 is preferably closed off after the wire is inserted. If the ends are sealed, the result is that the body ends such as end 22 are slightly smaller than the diameter of the remainder of body 12. This sealing serves to help close off the open ends of aperture 20 and may be achieved with heat, glue, epoxy, heat activated adhesive, or other adhesives.

Figure 4:
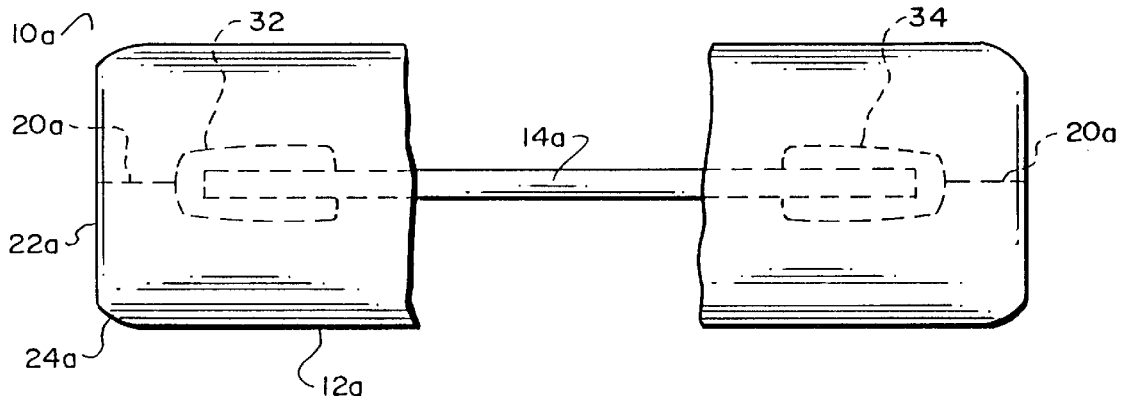
FIG. 4 is a view similar to that of FIG. 1 for another style of flexible foam construction toy according to this invention.
Figure 5:
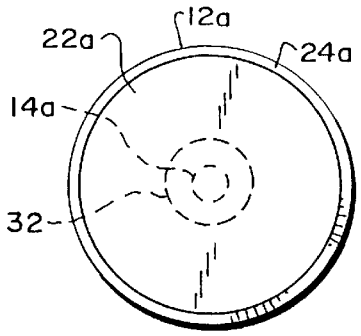
FIG. 5 is an end view of the toy of FIG. 4.
Figure 6:
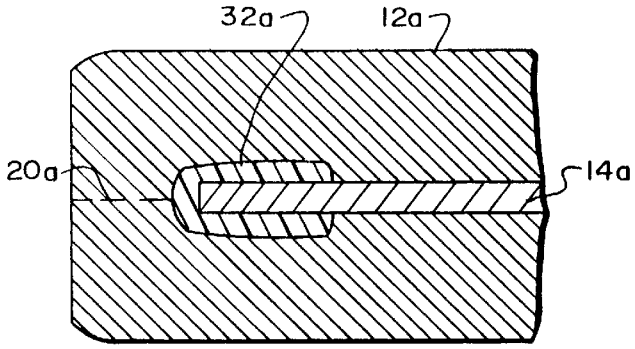
FIG. 6 is a partial cross sectional view of the toy of FIG. 4.

An alternative construction of toy 10*a* is shown in FIGS. 4 through 6. Wire 14*a* is provided with enlarged ends in this case by sealing or gluing caps 32 and 34 on the ends of the wire. These caps may be similar to wire nuts. Another type of enlarged end is made by looping the wire ends back on themselves. The construction may also be accomplished with two half foam pieces (such as half-circular cross-section) with a central channel, into one of which wire 14*a* is laid before the halves are adhered together, leaving seam 20*a*.

Figure 7A:
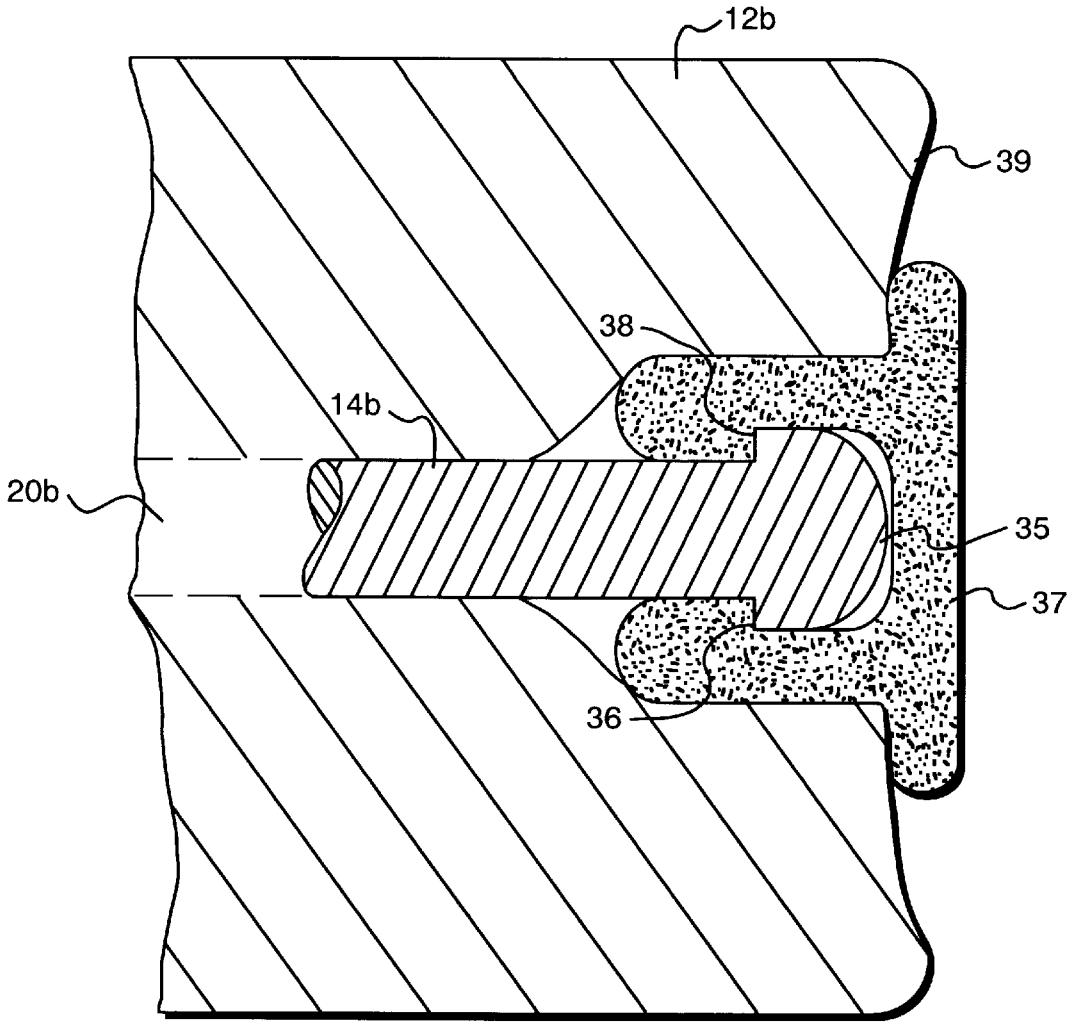
FIG. 7A is a cross-sectional view of another embodiment, detailing a manner of closing off the end of the foam body with a cap.

FIG. 7 details another manner of closing off the ends of the foam body to prevent the wire from poking out through the ends. This method can also be used to cap wire ends when the wire is longer than the foam body. Wire 14*b* has enlarged end 35 which can be formed by stamping. After wire 14*b* is inserted in channel 20*b* in the center of foam body 12*b*, plastic end cap 37 is fitted over the end of wire 14*b*. Cap 37 has shoulder 38 that snaps over and mates with corresponding shoulder 36 of wire 14*b* to keep cap 37 on the end of wire 14*b*.

The foam tubes are preferably from 1' to 6' long, and 3/4" to 2" in diameter. Shorter tubes are too short to be interconnected by wrapping around one another, and longer tubes are unwieldy for children. The thickness of the foam body needs to be such that it is thick enough to provide the feel of a foam tube rather than a plastic-coated wire, and also thick enough to inhibit the wire from puncturing through the foam body. For the preferred embodiment in which the wire is 1/4" diameter 0-temper aluminum, it has been found that the minimum tube diameter is approximately 3/4". The maximum tube diameter is chosen such that the thickness of the foam is not so great as to require a much thicker wire in order to hold a bent shape—thicker foam pieces have greater restorative force tending to force the tubes back to their straight starting shape. For cylindrical tubes greater than 2" in thickness, the 0-temper aluminum wire would have to be much thicker than the 1/4" preferred thickness in order to be sufficiently strong to overcome this foam restorative force. This would make the tubes that much more expensive to manufacture and that much heavier, partially defeating the purpose of a lightweight, flexible toy set in which the toy shapes can be directly interconnected without the need for integral or separate interconnection structures.

Figure 8A:
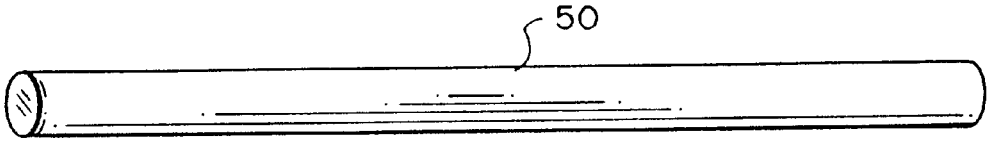
FIGS. 8A through 8D are an unbent and three bent shapes, respectively, of a flexible foam construction toy according to this invention having a circular cross section.
Figure 8B:
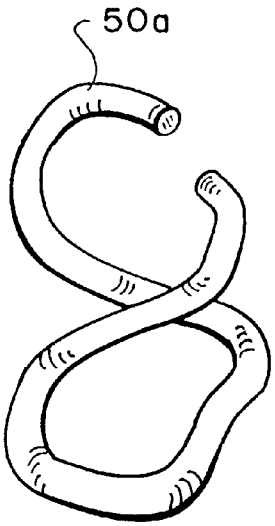
Figure 8C:
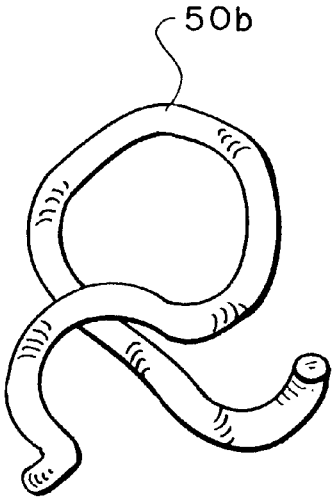
Figure 8D:
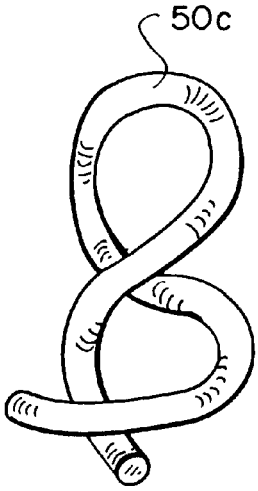
Figure 9A:
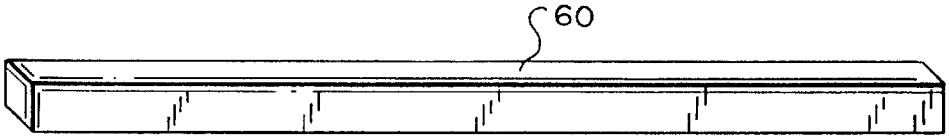
FIGS. 9A through 9D are similar views for a toy having a square cross section.
Figure 9B:
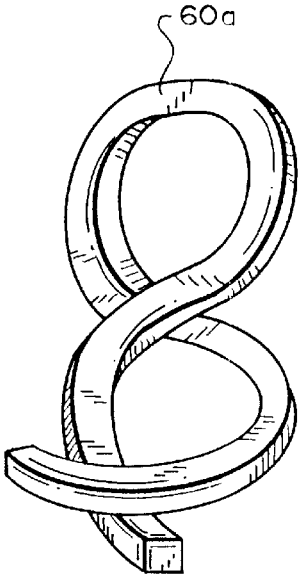
Figure 9C:
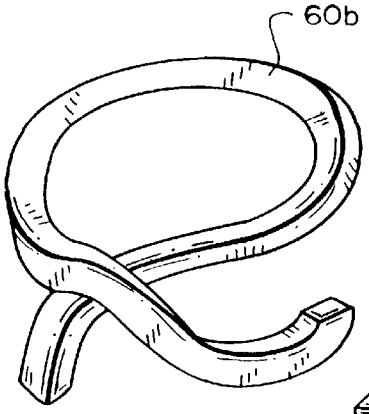
Figure 9D:
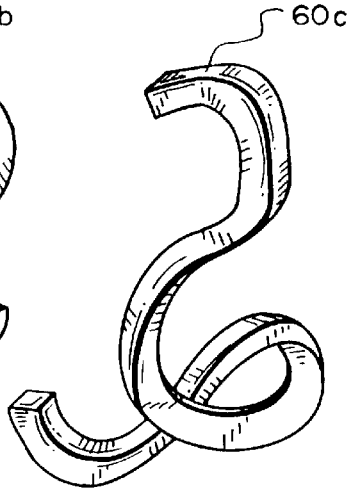
Figure 10A:
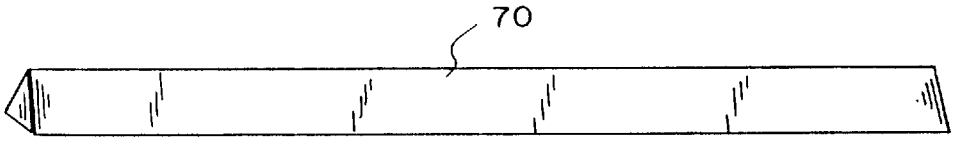
FIGS. 10A through 10D are similar views for a toy having a triangular cross section.
Figure 10B:
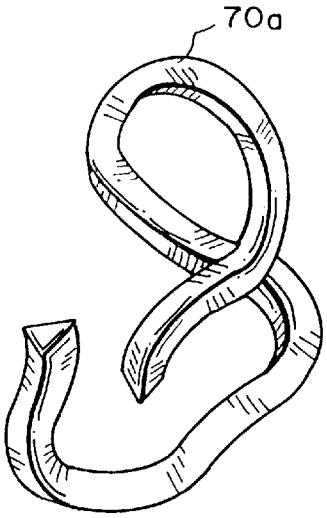
Figure 10C:
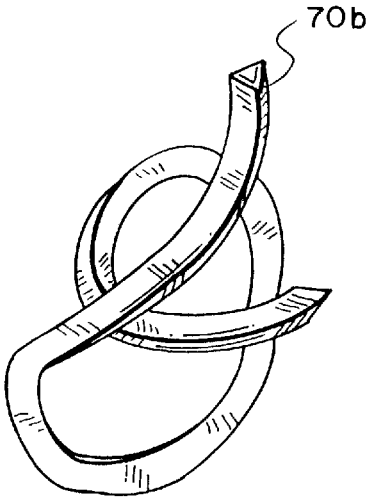
Figure 10D:
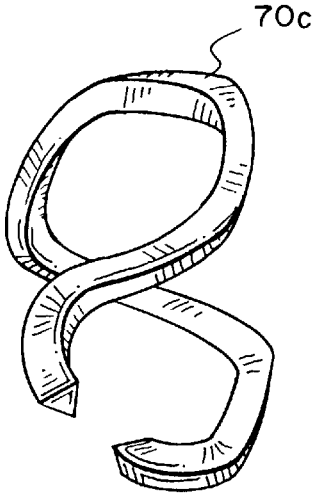
Figure 11A:
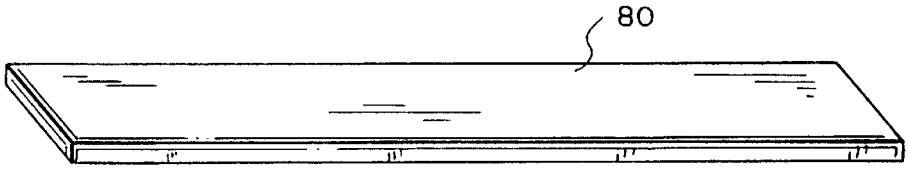
FIGS. 11A through 11D are similar views for a toy having a rectangular cross section.
Figure 11B:
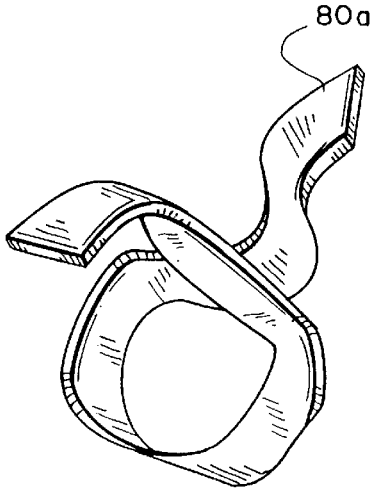
Figure 11C:
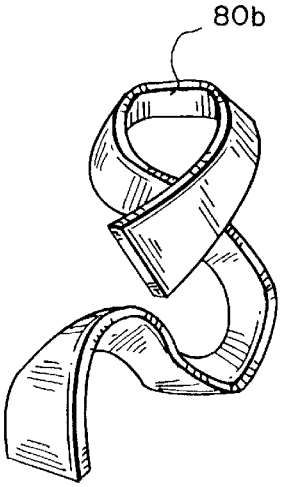
Figure 11D:
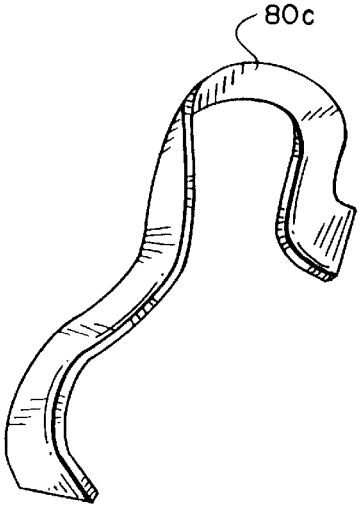
Figure 12A:
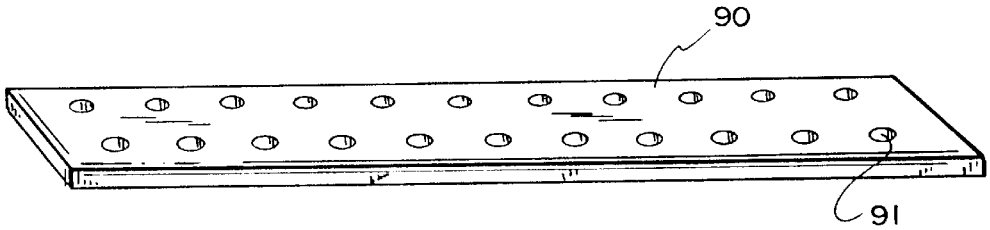
FIGS. 12A through 12D are similar views for a toy having a rectangular cross section and holes therethrough.
Figure 12B:
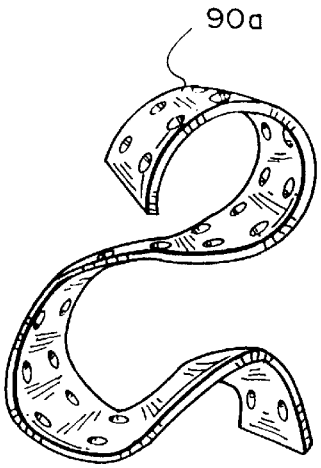
Figure 12C:
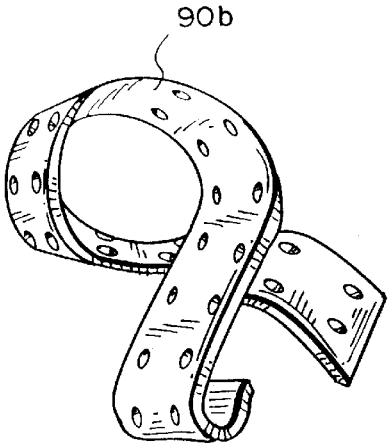
Figure 12D:
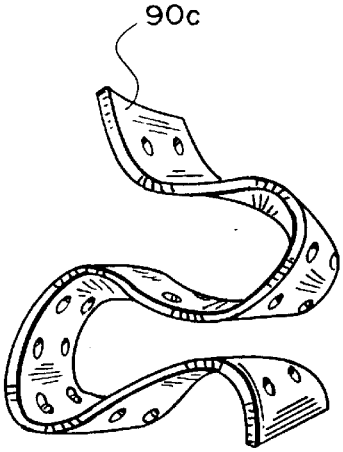

The foam construction toy of this invention can take any one or more of virtually unlimited shapes. In manufacturing, it is advantageous to choose shapes which may be extruded. One shape is a circular tube 50 through 50*c*, FIGS. 8A through 8D. FIGS. 8B and 8D illustrate three of a virtually unlimited number of shapes which that toy may be bent into. Similar drawings are shown for tubes 60 through 60*c* with a square cross section, FIGS. 9A through 9D; tubes 70 through 70*c* with a triangular cross section, FIGS. 10A through 10D; rectangular bars 80 through 80*c* with a rectangular cross section, FIGS. 11A though 11D; and rectangular bars 90 through 90*c*, FIGS. 12A through 12D, which have a rectangular cross section and include a number of through-holes such as hole 91 which allow this piece to be connected to the tube-shaped pieces by passing the tubes through the holes.

Figure 7B:
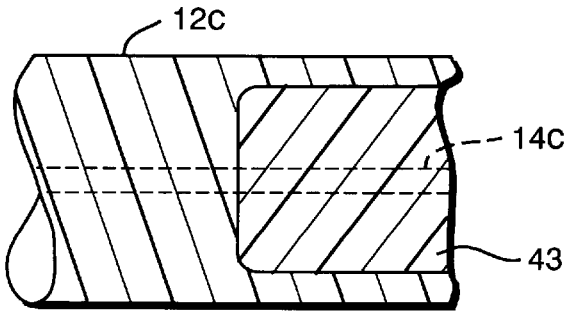
FIG. 7B details another end-finishing scheme.

The toys of the toy set of this invention can be produced in any manner which creates elongated flexible foam tubes that can be bent to, and will retain, different shapes by having a wire embedded in the foam. For example, the wire and foam could be co-extruded, with the adhesive being applied to the wire just before the foam is extruded around the wire. Also contemplated are other tube end-finishing schemes, as opposed to closing the ends of the tubes using heat or adhesive, or adding separate end caps that fit over the wire and/or are adhered to the wire and/or tube. Alternatively, as shown in FIG. 7B, the ends of the foam tube 12*c* could be partially removed to create a hollow shell portion with protruding wire 14*c*, which could then be filled with a relatively soft material 43 that sets up to be firm enough to stay in place. A plastic, or a mixture of plastic and adhesive, could be used. In this case, it would be important to select a material, or combinations of materials, that stayed in place within the cavity, yet was light enough and soft enough to be acceptable as the end piece of a foam tube toy. For example, a mixture of a low melt adhesive and the plastic that the tubes are made from could be flowed into the cavity warm, to set up in place. The plastic could also be foamed in place to decrease the mixture density.

FIG. 13 is a drawing of a fanciful assembly made with a number of flexible foam construction toy pieces according to this invention. Rectangular base/support pieces 100 and 101 have a cylindrical hole for snugly receiving and supporting cylindrical pieces 50*d* and 50*e* which in turn support the other pieces, including rectangular bars 90*a* and 90*b* which have through holes as shown, disk-shaped pieces 102 and 104 which may have holes for holding cylindrical pieces such as 50*q*, longer cylindrical pieces 50*f*through 50*h*, and shorter cylindrical pieces 50*i* through 50*p*. Flat shapes that are simply stamped foam pieces without an embedded wire include star-shaped piece 106, triangular piece 108, bars 90*a* and 90*b*, disks 102 and 104, cylinders 50*i* to 50*q*, and sawtooth piece 110, each of which may have one or more holes adapted to snugly receive another piece of the set to allow the user to create myriad fanciful designs. These shapes also provide additional shape and dimensionally to designs, which can animate figures created with the posable cylinders of this invention. An alternative base structure would be a flat box shape with holes sized to fit the different toy set pieces; this would allow standing structures to be built on the base.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A flexible foam construction toy set, comprising:

a plurality of flexible, wire core, elongated foam tube, toy pieces having ends, each toy piece capable of retaining a bent shape due to the wire core; wherein each toy piece is capable of interconnection to another toy piece by wrapping crosswise fully around another toy piece, to allow the pieces to be interconnected without the need for defined interconnection structure; and a number of foam decorative pieces, each having one or more through holes sized and shaped to fit a tube toy piece therethrough, and to grip the tube toy piece, with an interference fit to add decoration to the tube toy pieces.

2. The flexible foam construction toy set of claim 1 in which at least one of the toy pieces has a regular shape, and a length-to-width aspect ratio of at least about 36, to facilitate the wrapping interconnection.

3. The flexible foam construction toy set of claim 2 in which toy pieces in the toy set have aspect ratios of from about 36 to about 54.

4. The flexible foam construction toy set of claim 1 further including a base member having a plurality of openings sized and shaped to fit therein one or more of the tube toy pieces, to hold tube toy pieces upright therein so that standing structures may be constructed on the base member.

5. The flexible foam construction toy set of claim 1 further including one or more foam tube interconnection pieces having at least two holes sized and shaped to fit a tube toy piece therethrough, and to grip the tube toy piece, to hold tube toy pieces in a predefined, spaced-apart relationship.

6. The flexible foam construction toy set of claim 1 in which at least some of said toy pieces include a wire core that is shorter than said toy pieces.

7. The flexible foam construction toy set of claim 6 in which said toy pieces with a wire core shorter than said toy pieces include a foam tube with an aperture in which the wire core is located.

8. The flexible foam construction toy set of claim 7 in which said toy pieces with an aperture include foam tubes with their ends closed around the aperture, to fully encapsulate the wire core.

9. The flexible foam construction toy set of claim 1 further including an adhesive substance between said wire core and said foam tube of said toy pieces, to more firmly hold said wire core in said foam tube.

10. The flexible foam construction toy set of claim 1 in which at least some of said toy pieces have a generally circular cross-sectional shape.

11. The flexible foam construction toy set of claim 1 in which at least some of said toy pieces have a length of at least one foot, to facilitate the wrapping interconnection.

12. A flexible foam construction toy set, comprising:

a plurality of flexible, wire core, elongated foam tube, toy pieces having ends, each toy piece capable of retaining a bent shape due to the wire core; wherein each toy piece is capable of interconnection to another toy piece by wrapping crosswise fully around another toy piece, to allow the pieces to be interconnected without the need for defined interconnection structure;

wherein at least one of the toy pieces has a regular shape, and a length-to-width ratio of at least about 36, to facilitate the wrapping interconnection; and a number of foam decorative pieces, each having one or more through holes sized and shaped to fit a tube toy piece therethrough, to grip the tube toy piece with an interference fit, and to add decoration to the tube toy pieces.

13. The flexible foam construction toy set of claim 11 further including one or more foam tube interconnection pieces having at least two holes sized and shaped to fit a tube toy piece therethrough, and to grip the tube toy piece to hold tube toy pieces in a predefined, spaced-apart relationship.

14. The flexible foam construction toy set of claim 11 in which at least some of said toy pieces include a wire core that is shorter than said toy pieces.

15. The flexible foam construction toy set of claim 14 in which said toy pieces with a wire core shorter than said toy pieces include a foam tube with an aperture in which the wire core is located.

16. The flexible foam construction toy set of claim 15 in which said toy pieces with an aperture include foam tubes with their ends closed around the aperture, to fully encapsulate the wire core.

17. The flexible foam construction toy set of claim 11 further including an adhesive substance between said wire core and said foam tube of said toy pieces, to more firmly hold said wire core in said foam tube.

18. The flexible foam construction toy set of claim 11 further including a number of foam decorative pieces, each having one or more through holes sized and shaped to fit a tube toy piece therethrough, and to grip the tube toy piece, to add decoration to the tube toy pieces.

19. The flexible foam construction toy set of claim 11 in which at least some of said toy pieces have a length of at least one foot, to facilitate the wrapping interconnection.

20. A flexible foam construction toy set, comprising:

a plurality of flexible wire core, elongated foam tube, toy pieces having ends, each toy piece capable of retaining a bent shape due to the wire core; wherein each toy piece is capable of interconnection to another toy piece by wrapping crosswise fully around another toy piece, to allow the pieces to be interconnected without the need for defined interconnection structure wherein at least some of said toy pieces have a foam tube diameter to wire diameter ratio of at least about 3;

a number of foam decorative pieces, each having one or more through holes sized and shaped to fit a tube toy piece therethrough, to grip the tube toy piece with an interference fit, and to add decoration to the tube toy pieces; and a base member having a plurality of openings sized and shaped to fit therein one or more of the tube toy pieces, to hold tube toy pieces upright therein so that standing structure may be constructed on the base member.

21. The flexible foam construction toy set of claim 20 wherein said at least some of said toy pieces have a foam tube diameter to wire diameter ratio of from about 3 to about 8.

22. A flexible foam construction toy set, comprising:

a plurality of flexible, wire core, elongated foam tube, toy pieces, having ends, each toy piece capable of retaining a bent shape due to the wire core; wherein each toy piece is capable of interconnection to another toy piece by wrapping crosswise fully around another toy piece, to allow the pieces to be interconnected without the need for defined interconnection structure;

a number of foam decorative pieces, each having one or more through holes sized and shaped to fit a tube toy piece therethrough, to grip the tube toy piece with an interference fit, and to add decoration to the tube toy pieces; and wherein at least one of the toy pieces has a length of at least one foot, to facilitate the wrapping interconnection.

23. The flexible foam construction toy set of claim 22 including a plurality of the wire core foam tube toy pieces having lengths of from one to six feet.

24. The flexible foam construction toy set of claim 22 further including one or more foam tube interconnection pieces having at least two holes sized and shaped to fit a tube toy piece therethrough, and to grip the tube toy piece to hold tube toy pieces in a predefined, spaced-apart relationship.

25. A flexible foam construction toy set, comprising:

a plurality of flexible wire core, elongated foam tube, toy pieces having ends, each toy piece capable of retaining a bent shape due to the wire core; wherein each toy piece is capable of interconnection to another toy piece by wrapping crosswise fully around another toy piece, to allow the pieces to be interconnected without the need for defined interconnection structure;

a base member having a plurality of openings sized and shaped to fit therein one or more of the tube toy pieces, to hold tube toy pieces upright therein so that standing structures may be constructed on the base member;

a number of flat foam decorative pieces, each having one or more through holes sized and shaped to fit a tube toy piece therethrough, and to grip the tube toy piece with an interference fit, to add decoration to structures constructed of the tube toy pieces; and one or more flat foam decorative tube interconnection pieces having at least two holes sized and shaped to fit a tube toy piece therethrough, and to grip the tube toy piece to hold tube toy pieces in a predefined, spaced-apart relationship.

26. A flexible foam construction toy set, comprising:

a plurality of flexible wire core, elongated foam tube, toy pieces having ends, each toy piece capable of retaining a bent shape due to the wire core; wherein each toy piece is capable of interconnection to another toy piece by wrapping crosswise fully around another toy piece, to allow the pieces to be interconnected without the need for defined interconnection structure; wherein at least some of said toy pieces include a wire core that is shorter than said toy pieces, and said toy pieces with a wire core shorter than said toy pieces include a foam tube with an aperture in which the wire core is located, with their ends closed around the aperture to fully encapsulate the wire core;

a base member having a plurality of openings sized and shaped to fit therein one or more of the tube toy pieces, to hold tube toy pieces upright therein so that standing structure may be constructed on the base member;

wherein at least one of the toy pieces has a regular shape, and a length-to-width aspect ratio of at least about 36, to facilitate the wrapping interconnection;

a number of flat foam decorative pieces, each having one or more through holes sized and shaped to fit a tube toy piece therethrough, and to grip the tube toy piece with an interference fit, to add decoration to structures constructed of the tube toy pieces; and an adhesive substance between said wire core and said foam tube of said toy pieces, to more firmly hold said wire core in said foam tube.

27. A flexible foam construction toy set, comprising:

a plurality of flexible, wire core, elongated foam tube, toy piece, having ends, each toy piece capable of retaining a bent shape due to the wire core; wherein each toy piece is capable of interconnection to another toy piece by wrapping crosswise fully around another toy piece, to allow the pieces to be interconnected without the need for defined interconnection structure;

a number of foam decorative pieces, each having one or more through holes sized and shaped to fit a tube toy piece therethrough, to grip the tube toy piece with an interference fit, and to add decoration to the tube toy pieces; and wherein at least one of the toy pieces has a round cross section and is at least about 2" in diameter.

28. A flexible foam tube toy capable of retaining a bent shape, the toy comprising a foam body having ends and being at least one foot long;

at least one foam decorative piece, having one or more through holes sized and shaped to fit the tube toy piece therethrough, to grip the tube toy piece with an interference fit, and to add decoration to the tube toy; and a wire core embedded in the foam body to assist in maintaining a bent, poseable shape of the tube toy.

29. The flexible foam tube toy of claim 28 in which the wire core has a diameter of at least 1/32".

30. The flexible foam tube toy of claim 28 in which the foam body has a round cross section and is at least about 2" in diameter.

31. The flexible foam tube toy of claim 28 in which the foam body has a round cross section and is at least about 2" in diameter, and the wire core has a diameter of at least 1/32".

* * * * *